United States Patent [19]

Kobayashi et al.

[11] Patent Number: 4,488,682

[45] Date of Patent: Dec. 18, 1984

[54] COOLING SYSTEM FOR POST-MIXED BURNER

[75] Inventors: Hisashi Kobayashi, Putnam Valley; William J. Snyder, White Plains, both of N.Y.

[73] Assignee: Union Carbide Corporation, Danbury, Conn.

[21] Appl. No.: 529,993

[22] Filed: Sep. 7, 1983

[51] Int. Cl.[3] ..... B05D 15/00

[52] U.S. Cl. ..... 239/132.3; 239/596

[58] Field of Search ..... 239/132.3, 596

[56] References Cited

U.S. PATENT DOCUMENTS

| | | | |
|---|---|---|---|
| 2,971,578 | 2/1961 | Davis | 239/132.3 |
| 3,121,457 | 2/1964 | Whipple et al. | 239/132.3 |
| 3,202,201 | 8/1965 | Masella et al. | 239/132.3 |

FOREIGN PATENT DOCUMENTS

| | | | |
|---|---|---|---|
| 1088435 | 9/1960 | Fed. Rep. of Germany | 239/596 |

OTHER PUBLICATIONS

Arnold, G. D., Developments in the use of Oxy/Gas Burners, Journal of the Institute of Fuel, Mar. 1967, pp. 117–121.

Jet Burner, Nikko Industry Co., Ltd., Kobe, Japan.

Jet Burner E-Type, Nikko Industry Co., Ltd., Kobe, Japan.

*Primary Examiner*—Carroll B. Dority, Jr.

*Attorney, Agent, or Firm*—Stanley Ktorides

[57] ABSTRACT

A post-mixed burner having a cooling system which brings cooling water preferably from the area of the fuel tube, across the area of oxidant passages, proximate the burner face, and out of the burner preferably in the outermost conduit.

6 Claims, 2 Drawing Figures

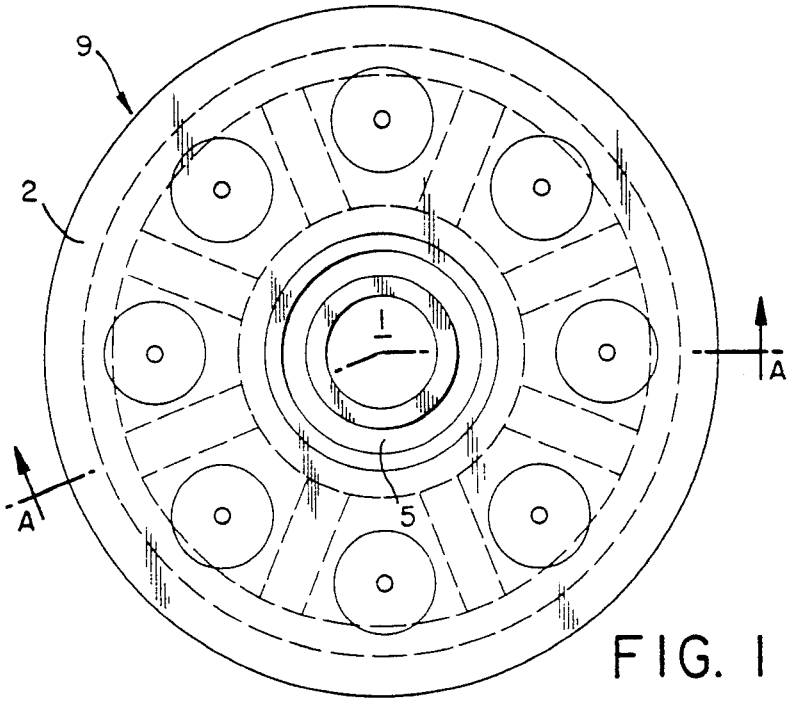
FIG. 1
FIG. 2
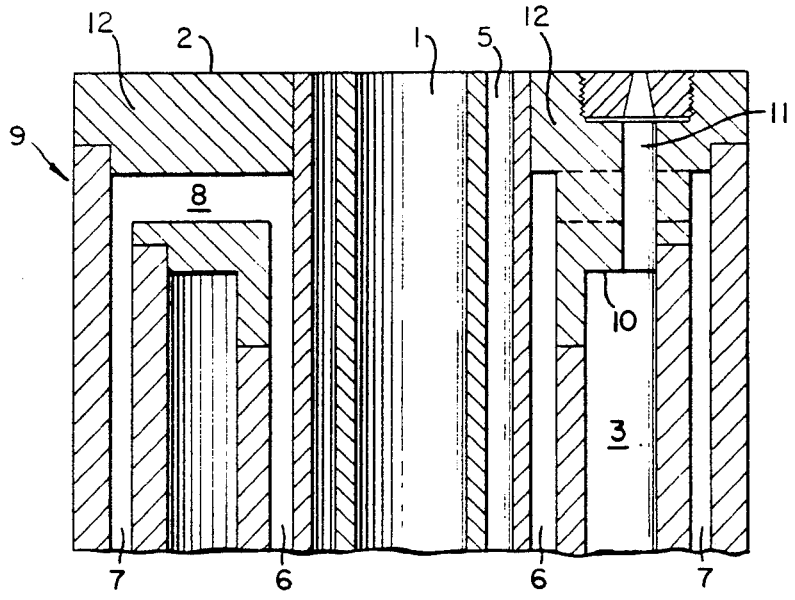

COOLING SYSTEM FOR POST-MIXED BURNER

TECHNICAL FIELD

This invention relates to a cooling system for a post-mixed burner having separate fuel and oxidant conduits which discharge into a furnace at the burner face.

BACKGROUND ART

Burners which operate in high temperature furnaces are cooled in order to preserve the structural integrity of the burner components and to retard the oxidation rate of hot metallic surfaces. In conventional burners using ambient air as the oxidant, adequate cooling of the burner is generally provided by the combustion air.

Recently the use of oxygen or oxygen-enriched air has been gaining prominence as an oxidant for burners because its use is more energy efficient and less pollution generating than the use of air. However, use of oxygen or oxygen-enriched air as the burner oxidant has resulted in a number of problems with conventional cooling systems designed to cool a burner which uses air as the oxidant.

First, as is well known, oxygen or oxygen-enriched air typically produces a hotter flame than that produced by air. Thus oxygen burners are exposed to higher heat flux from the flame. A second problem with oxygen burners results from the fact that the volume of the oxidant required to burn a unit amount of fuel is reduced significantly as compared with an air burner. Thus it is difficult to provide adequate cooling of the burner using the oxidant.

Cooling of burners using oxygen or oxygen-enriched air is often provided by a separate cooling fluid. The most common cooling fluid is water. The amount of heat that cooling water is able to remove is a function of the conduction heat transfer from hot surfaces to water cooled surfaces and the convection heat transfer from water cooled surfaces to the water. It is generally desirable to provide cooling water as close to the hot surfaces as possible at a sufficient velocity to effectively transfer heat from the hot surfaces to water.

For a post-mixed burner having separate fuel and oxidant conduits which discharge into a furnace or a small burner block at the burner face, it is desirable that both the fuel and the oxidant conduits as well as the burner exterior surfaces be directly cooled by water in order to provide effective cooling.

One known method for providing cooling to a post-mixed burner is to provide cooling fluid in an incoming and outgoing annular stream between the fuel and annular oxidant conduits and in a separate incoming and outgoing annular stream on the outside of the oxidant conduit. Although such a system adequately cools the fuel and oxidant conduits and brings cooling fluid quite close to the burner face, it is disadvantageous because of the high fabrication costs required for the two separate cooling streams and also because it significantly increases the burner outside diameter.

Another known cooling system for a post-mixed burner which can be employed when the oxidant and fuel are delivered to the burner face in separate, i.e. not concentric, tubes employs a number of oxidant tubes submerged in cooling water. Such a system effectively cools the burner but has the disadvantages of high fabrication costs, especially when the number of oxidant tubes is large, such as greater than four, and of high pressure drop in the oxidant tubes because of the small total cross-sectional area of the oxidant tubes.

It is often desirable to outfit the discharge end of oxidant tubes with directional nozzles which direct the oxidant flow in a direction other than straight ahead. It is further desirable that such nozzles be replaceable to allow for a variety of flow directions. However, such replaceable nozzles require a solid portion proximate the burner face in order to provide a threaded seat to hold the nozzles. This portion is more susceptible to overheating because of its proximity to the burner face. The burner having a cooling system such as the one first described above is not applicable to this situation since it employs an annular oxidant tube. Replaceable nozzles are employed only on separate oxidant passages. The problem of cooling such a burner is made greater by the cooling requirements of the replaceable nozzles which can oxidize and seize in the threaded area thus rendering them incapable of removal.

It is therefore an object of this invention to provide a burner having an improved cooling system.

It is another object of this invention to provide a compact cooling system for a post-mixed burner which uses oxygen or oxygen-enriched air as the oxidant.

It is a further object of this invention to provide an effective cooling system for a burner which employs replaceable nozzles.

SUMMARY OF THE INVENTION

The above and other objects which will become apparent to those skilled in the art upon a reading of this disclosure are attained by: A burner comprising:

(a) a fuel tube having its discharge end at the burner face;

(b) an annular oxidant passageway circumferentially around said fuel tube and axially along said fuel tube to a point short of the burner face so as to define a space between said point and the burner face;

(c) a plurality of oxidant passages passing through said defined space, connected to and communicating with said annular oxidant passageway at said point and having their discharge end at the burner face;

(d) a second annular passageway circumferentially around said fuel tube and extending along said fuel tube into said defined space, adapted for flow of cooling fluid and positioned between said fuel tube and said annular oxidant passageway;

(e) a third annular passageway circumferentially around both said fuel tube and said oxidant passageway, extending into said defined space and adapted for flow of cooling fluid; and (f) at least one connecting conduit, connecting said second and third annular passageways, in said defined space.

BRIEF DESCRIPTION OF THE DRAWINGS

FIG. 1 is a view of one preferred embodiment of the burner of this invention as it would be seen from a furnace.

FIG. 2 is a cross-sectional representation of FIG. 1 seen along the section A—A.

DETAILED DESCRIPTION

The burner of this invention will be described in detail with reference to the drawings. As indicated above, the drawings depict one preferred embodiment of the burner of this invention. The numerals for FIG. 1 and 2 are identical for the common elements of burner 9.

Fuel is delivered to the furnace through fuel tube 1 and is discharged into the furnace at the burner face 2 which is essentially perpendicular to the flow direction of fuel through fuel tube 1. The burner may be flush with the furnace wall or recessed a short distance in a burner block as is well known to those skilled in this art. Oxidant annulus 3 is circumferentially around fuel tube 1 and extends axially along the fuel tube to a point 10. At this point the oxidant annulus is connected to and communicates with a plurality of oxidant passages 11 which extend from the oxidant annulus to burner face 2 and discharge into the furnace. The burner comprises a relatively solid portion 12 from the burner face to point 10. This portion is commonly referred to as the burner head. It is preferred that the burner head be a unitary piece as this will facilitate heat transfer better than a piece which has been welded or otherwise fastened together. The plurality of oxidant passages 11 extend through portion or space 12 from the oxidant annulus to the burner face essentially parallel to fuel tube 1. Space 12 may conveniently also contain threaded seats for the easy attachment and removal of replaceable nozzles.

The embodiment of FIGS. 1 and 2 is a preferred embodiment wherein there are eight oxidant passages equispaced around one central fuel tube. Each oxidant passage is equipped with a nozzle 4 which is threaded for easy removal and replacement. The illustrated preferred embodiment also has a small annular conduit 5 for the delivery of annular oxidant to the fuel stream in order to stabilize the flame. Such a small annular conduit is particularly useful when the oxidant is oxygen.

Cooling fluid is preferably provided to the burner through second annular passageway 6 which is positioned axially along and radially around the fuel tube 1. This second annular passageway extends into space 12 and preferably extends as close to burner face 1 as possible. The cooling fluid is preferably removed from the burner through third annular passageway 7 which is positioned axially along and radially around both fuel tube 1 and annular oxidant passageway 3 and extends into space 12. Preferably third annular passageway 7 extends as close to burner face 2 as does second annular passageway 6. Annular passageways 6 and 7 are connected to one another by at least one connecting conduit 8. The illustrated embodiment depicts a preferred arrangement wherein there are eight connecting conduits 8, each between two different oxidant passages 11. Each connecting conduit 8 being parallel to the burner face and connecting both the second and third annular passageways at their respective points most proximate burner face 2. As mentioned, it is preferable that cooling fluid be provided to the burner through passageway 6 and removed from the burner through passageway 7. However, if desired, the roles of these passages may be reversed, i.e., the cooling fluid could be provided to the burner through passageway 7 and withdrawn from the burner through passageway 6.

In operation, fuel which is generally coke oven gas or natural gas, and oxidant flow in their separate conduits and are discharged through the discharge end of each conduit into the furnace at the burner face. Combustion occurs upon mixture of the fuel and oxidant. Due to the intense flame created proximate to the burner face, the burner components are subject to high heat flux resulting in heating of the burner components.

Cooling fluid, generally preferably water, is brought to the hot area preferably through second annular passageway 6. The cooling water flows to the end of passageway 6 inside space 12 where it is directed radially outward through conduit 8 and into third annular passageway 7, through which the warmed cooling water is removed from the burner.

The components of burner 9 for which cooling is most important are the burner face, the oxidant nozzles and the fuel tube. Cooling is very important for the burner face because it is the component closest to the combustion reaction thus receiving more heat than other burner components. Cooling is very important for the oxidant nozzles because high temperatures will increase the oxidation rate and possibly result in the threaded area seizing, rendering the nozzles unremovable. Cooling is very important to the fuel tube because due to the small annular oxidant conduit, the fuel tube surface is not directly water cooled.

The cooling system of the burner of this invention successfully addresses each of these concerns. First, preferably the cooling water flows closest to the fuel tube when it is in its coldest condition thus facilitating heat removal from the fuel tube by radiation heat transfer even though there is no direct contact between the hot fuel tube and a water cooled surface. Second, the cooling water flows completely around or across the oxidant passages within space 12 and proximate the burner face. This facilitates heat removal from larger portions of the oxidant nozzles than is possible with conventional designs. Third, the cooling water flows across a larger area proximate the burner face because it flows in from close to the fuel tube on the inside of the oxidant passages, across the oxidant passages, and out on the outside of the oxidant passages. The large area proximate the burner face where the cooling were flows across the oxidant passages through connecting conduits 8 greatly improves the heat removal from the burner face.

The following examples serve to further illustrate the benefits of the burner of this invention of demonstrate the advantages of the burner of this invention over the cooling available with use of a conventional cooling arrangement.

EXAMPLE 1

A burner similar to that depicted in FIGS. 1 and 2 was extended into a hot furnace and cooled by flowing cooling water through the burner at the rate of 8.1 gallons per minute (gpm). The cooling fluid flowed in the preferred direction of toward the burner face in passageway 6, radially outward through conduits 8 and away from the burner face through passageway 7. At steady state conditions the furnace temperatures was 2397° F., the temperature of the fuel tube at the discharge end was 1901° F. and the temperature of the oxidant nozzles was 232° F. The heat carried away by the cooling water, calculated based on the rise in water temperature and the flowrate was 0.073 million BTU per hour. The temperature of the incoming water was 61° F. and the temperature of the outgoing water was 79° F.

The cooling water flowrate was then reduced to 4.1 gpm and at steady state the temperature of the fuel tube discharge end was 1902° F., the temperature of the oxidant nozzles was 246° F. and the heat removal was at a rate of 0.066 million BTU per hour. The incoming water temperature was 62° F. and the outgoing water temperature was 94° F.

For comparative purposes a post-mixed burner was extended into a hot furnace and cooled using cooling water flowing through a conventional cooling system wherein cooling water is supplied through an annular cavity radially outward from the annular oxygen passageway, and is removed by directing the water flow 180 degrees into another annular cavity radially outward the first. The cooling water flowrate was 8 gpm. The temperature of the furnace was 2326° F., the temperature of the fuel tube at the discharge end was 1994° F. and the temperature of the oxidant nozzles was 490° F. Heat removal was at a rate of only 0.040 million BTU per hour. The incoming water temperature was 52° F. and the outgoing water temperature was 62° F.

It is thus demonstrated tat the cooling system of the burner of this invention produces significantly improved cooling over that attainable be conventional cooling systems for post-mixed burners.

As indicated earlier, the advantages of the burner of this invention are more apparent when oxygen or oxygen enriched air is the oxidant. Other advantages of this invention, in addition to those discussed earlier, are ease of manufacture due to a much smaller burner head with no internal threads, and ease of water distribution.

By the use of the burner and cooling system of this invention one can employ replaceable oxidant nozzles at the burner face and yet adequately cool the burner face and the portion of the burner proximate the burner face which is needed to support the nozzles. The cooling is accomplished by bringing cooling fluid toward the burner face preferably close to the inner fuel tube and on the inside of the major oxidant annulus. The cooling fluid travels past the end of the major oxygen annulus into the space through which pass the plurality of oxidant passages. In this space the cooling fluid is able to travel across the plurality of oxidant passages and proximate the burner face. From this point the cooling fluid travels out away from the burner face preferably on the outside of the major oxidant annulus.

We claim:

1. A burner comprising:

(a) a fuel tube having its discharge end at the burner face;

(b) an annular oxidant passageway circumferentially around said fuel tube and axially along said fuel tube to a point short of the burner face so as to define a space between said point and the burner face;

(c) a plurality of oxidant passages passing through said defined space, connected to and communicating with said annular oxidant passageway at said point and having their discharge end at the burner face;

(d) a second annular passageway circumferentially around said fuel tube and extending axially along said fuel tube into said defined space, adapted for flow for cooling fluid and positioned between said fuel tube an said annular oxidant passageway;

(e) a third passageway circumferentially around both said fuel tube and said oxidant passageway, extending into said defined space and adapted for flow of cooling fluid;

(f) at least one connecting conduit, connecting said second and third annular passageways at their respective points most proximate the burner face, in said defined space;

(d) a thick solid portion between the burner face and said connecting conduit(s), having a thickness sufficient to provide a seat to accomodate a directional removable nozzle, said thickness being at least twice the thickness of the outermost passageway wall;

(h) a metallic removable directional nozzle at the discharge end of at least one oxidant passage, said directional nozzle having a length greater than the greatest width of its opening and a forth passageway circumferentially around said fuel tube and positioned between said fuel tube and said second annular passageway, said forth passageway extending to the burner face for supplying oxidant.

2. The burner of claim 1 wherein said nozzle is threaded to render it removable.

3. The burner of claim 1 wherein said plurality of oxidant passages is equispaced around the fuel tube.

4. The burner of claim 1 wherein both the second and third annular passageway, at their closest approach to the burner face are the same distance from the burner face.

5. The burner of claim 1 wherein the connecting conduit is parallel to the burner face.

6. The burner of claim 1 wherein there is one connecting conduit between each pair of different oxidant passages.

* * * * *